US005974690A

United States Patent [19]

Canada

[11] Patent Number: 5,974,690

[45] Date of Patent: Nov. 2, 1999

[54] METHOD OF PROTECTING HAIR DRYERS HAVING VENTS

[76] Inventor: Billie Jack Canada, P. O. Box 596434, Dallas, Tex. 75359-6434

[21] Appl. No.: 08/744,948

[22] Filed: Nov. 7, 1996

[51] Int. Cl.[6] ..... F26B 3/00

[52] U.S. Cl. ..... 34/444; 34/343; 34/329; 392/385

[58] Field of Search ..... 34/96, 97, 82, 34/329, 343, 444, 443; 392/385, 383, 380

[56] References Cited

U.S. PATENT DOCUMENTS 5,112,374 5/1992 Ackerman ..... 55/385.1

5,216,822 6/1993 Madiedo ..... 34/82

5,331,748 7/1994 Miller, Jr. ..... 34/97

*Primary Examiner*—Henry Bennett

*Assistant Examiner*—Pamela A. Wilson

*Attorney, Agent, or Firm*—John P. Halvonik

[57] ABSTRACT

A disposable, adhesive air filter for use with hand held hair dryers. The filter is used in connection with the air vent openings of the hair dryer and may be applied retroactively onto such dryers. The filter may come in a roll or sheet and may be cut by the user to fit the size of his/her hair dryer. The filter should have adhesive on both sides and will be provided with a removable layer, e.g. a peel off layer, in order for the consumer to attach the filter to air vent holes on the hair dryer.

1 Claim, 1 Drawing Sheet

METHOD OF PROTECTING HAIR DRYERS HAVING VENTS

BACKGROUND AND FIELD OF THE INVENTION

The invention relates to the field of hair dryers and in particular, to an air filter designed to be used in connection with the hair dryer. The filter is designed to be sold as an off shelf item that the consumer can purchase and then attach to the hair dryer in order to increase the life of the hair dryer.

Most such hair dryers sold nowadays have a series of vent holes in the dryer. For purposes of convenience we refer to such arrangement as a "vent". Such vents may be found in some models on one or both sides, and, on other models, at one end, of the dryer. These vents serve to draw air through the dryer when the blower inside the dryer operates. As air rushes through the dryer all the time it is in operation, such vents are likely to pick up all sorts of particles, especially those in the air, such as lint, dust, etc. In a bathroom, there is even more likelihood of this as there is often hair spray in the air or simply more moisture in the air.

It is believed that the use of such adhesive filter in connection with the vent or the dryer will serve to collect dust, dirt, hair and other particles that would otherwise collect inside the hair dryer. It is believed that as such particles get inside the dryer they serve to decrease the life of the dryer. The use of an adhesive layer on the outside of the dryer and in connection with the air vent will provide a convenient gathering point at which to collect this hair, dirt, etc. before it gets into the inside of the dryer. With such method, it is thought that the usable lifetime of such a hair dryer could be extended 5 times the typical lifetime or longer.

DESCRIPTION OF THE PRIOR ART

There are no air filters known that are designed to be used in connection with hair dryers. Moreover, there are no such filters known to the applicant that have an adhesive layer in order to adhere dust, hair, etc. that would otherwise interfere with the operation of the hair dryer. It is also believed there are no known combinations of air filters and hair dryers that utilize an adhesive filter in connection with the air vent holes at the sides of the hair dryer.

SUMMARY OF THE INVENTION

A disposable, adhesive containing air filter and the combination of such filter with a hand held hair dryer. The filter is used in connection with the air vent opening(s) on the sides of hair dryers and may be applied retroactively by the consumer onto such dryers. Such an adhesive filter will gather hair and dust that would otherwise clog the hair dryer and thus prolong the life of the hair dryer. The filter may come in a roll or sheet and may be cut by the user to fit the size of his/or her hair dryer. The filter should have adhesive on both sides and will be produced with a removable layer e.g. a peel off layer in order for the consumer to attach the filter to air vent holes on the hair dryer.

It is among the objectives of the invention to provide a means to prevent premature aging and failure of hand held hair dryers.

Another objective to provide a hand held air dryer with an adhesive filter in order to prevent or minimize the gathering of dust, lint, hair, etc. inside of the hair and thus maximize the lifetime of the hair dryer.

Other objectives will be apparent to those skilled in the art once the invention is shown and described.

DESCRIPTION OF THE PREFERRED EMBODIMENT

Figure 1:
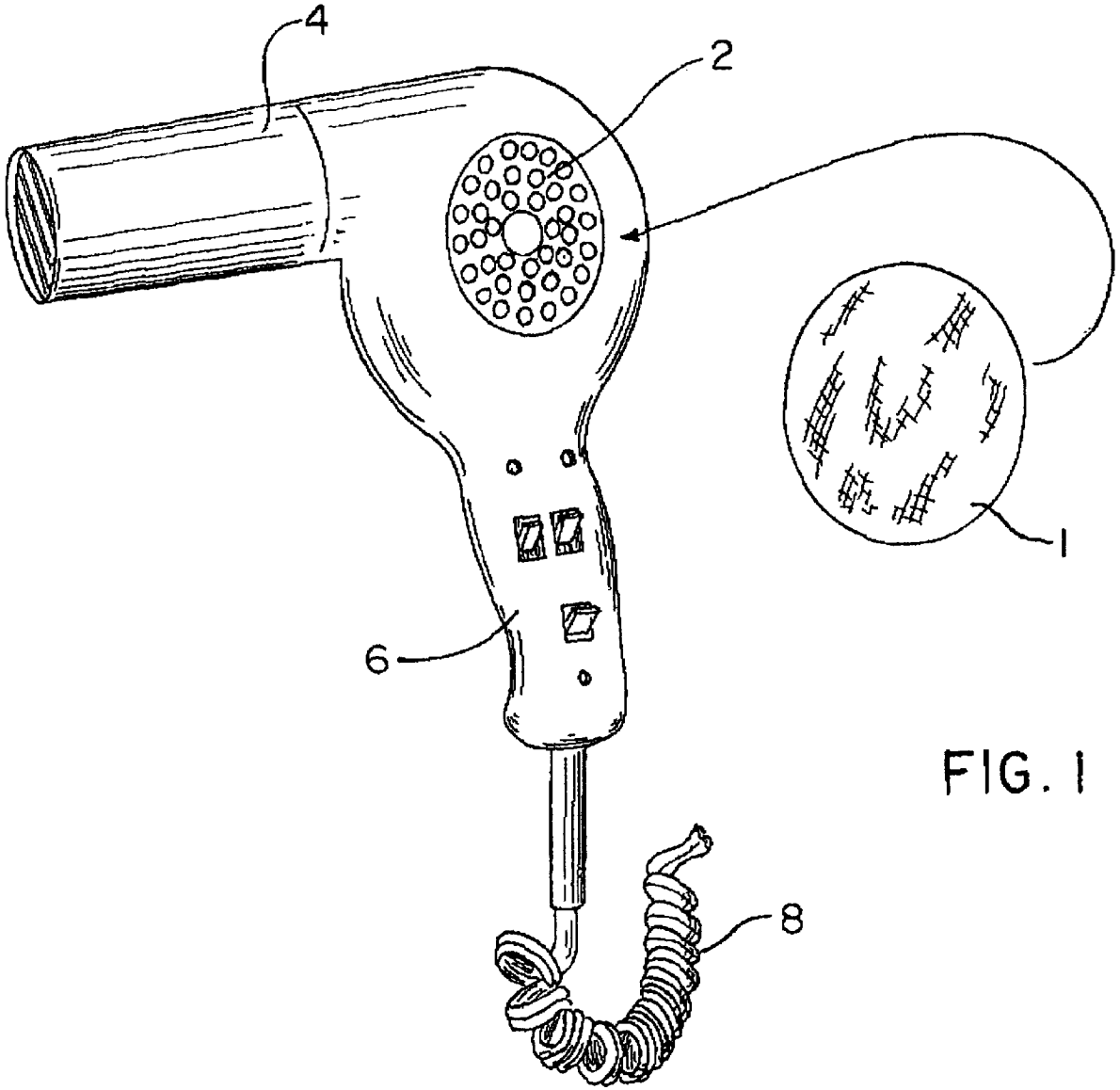
FIG. 1 use of the filter in connection with the hair dryer.

The overall arrangement of the filter 1 and the hair dryer 4 is as shown in FIG. 1. The filter should have adhesive material on at least one side so that the filter may be adhered to the vents (a side vent is shown as 2) that are typically found in the sides of hair dryers. At least one side of the filter should have adhesive material so that it will adhere to a surface once the backing layer is removed and pressure is applied to the material. optionally, both sides of the filter may have an adhesive layer. The consumer may remove the peel off layer when he or she is ready to adhere the filter onto the vent in the side of the dryer. Handle 6 and power cord 8 are shown for purpose of convenience.

The filter, and accompanying peel off layer, may sold in prepackaged sheets or rolls. Such sheets may be on the order of 10–20" length and width and may be cut by the consumer of a size to fit that particular size of the vent on the hair dryer that he or she owns.

When the user is ready to use the filter the filter is cut into a size that is convenient for that person's particular hair dryer. As most such vents in hair dryers are round, the user may use a drinking glass or other circular form in order to provide a pattern for cutting the filter to fit the vent. After the filter is cut to size, the user then removes one or both of the peel off layers and then attaches the filter to the vent of the hair dryer. After the filter is in place, the adhesive layer will gather hair, dirt, etc. It is believed that such a filter will have a usable lifetime of several months or years, after which, the user will simply take the roll of filter paper out and again cut a filter to fit the hair dryer.

It is preferred that the filter media be made of a mesh plastic. Other materials having small holes, such as cloth or fiberglass may find use in the invention. Such mesh will provide a place for the adhesive to adhere to and the openings in the mesh will be big enough to allow air to pass through. It is preferred that the mesh (or other material) have openings of about ⅛" to about 3⁄16". Such openings are thought adequate as they are small enough to stop large particles without interfering with the air flow.

I claim:

1. A method of protecting hair dryers having vents such method comprising the steps of: providing a sheet of material having two sides and having an adhesive coating on each of said sides and having at least one removable backing layer on one of said sides, said sheet having openings of a size and shape that will not hinder the intake of air into said vents, cutting out a portion of said sheet so as to provide a portion of sheet material that is of size and shape to cover said vents, removing said backing layer from said sheet to expose an adhesive coated side of said sheet and adhering said adhesive coated sheet to said vent so as to cover said vent and keep said vent free from dust and lint.

* * * * *